United States Patent [19]

Evans

[11] 4,004,214

[45] Jan. 18, 1977

[54] PHASE-CONTROLLED VOLTAGE REGULATOR

[75] Inventor: William C. Evans, Rochester, N.Y.

[73] Assignee: Viva-Tech, Inc., Rochester, N.Y.

[22] Filed: Mar. 28, 1975

[21] Appl. No.: 563,156

[52] U.S. Cl. ..... 323/19; 323/24; 323/34

[51] Int. Cl.[2] ..... G05F 3/04

[58] Field of Search ..... 307/252 B; 323/16, 19, 323/22 SC, 24, 34, 38

[56] References Cited

UNITED STATES PATENTS

| | | | |
|---|---|---|---|
| 3,522,522 | 8/1970 | Tiemann | 323/24 X |
| 3,532,855 | 10/1970 | Cleave | 323/24 X |
| 3,684,919 | 8/1972 | Cramer | 323/24 X |
| 3,742,337 | 6/1973 | Digneffe | 323/24 X |
| 3,742,373 | 6/1973 | Armstrong et al. | 323/24 X |
| 3,898,553 | 8/1975 | Boggett | 323/24 X |

*Primary Examiner*—A. D. Pellinen
*Attorney, Agent, or Firm*—Warren W. Kurz

[57] ABSTRACT

An r.m.s. voltage regulating circuit for maintaining substantially constant the r.m.s. output voltage of an A.C. source. The circuit preferably includes a triac and a timing circuit for controlling the non-conduction angle thereof, preferably at the beginning of each half cycle. A function generator compensates for the non-linearity in the relationship between the r.m.s. value of the output voltage and the amplitude of the A.C. voltage source.

2 Claims, 6 Drawing Figures

PHASE-CONTROLLED VOLTAGE REGULATOR

BACKGROUND OF THE INVENTION

This invention relates to improvements in voltage regulating apparatus. More particularly, it is directed to a voltage regulator which is particularly well suited for regulating the projection lamp voltage in a photographic printing apparatus.

Professional photographers, as well as many hobbyists, have come to realize that while regulation of the lamp voltage in a photographic enlarger is merely desirable in making individual black-and-white prints, it is almost an absolute necessity in producing color prints and in consistently producing stabilized black-and-white prints. Such a realization probably came as no surprise to the professional photographer, for manufacturers and suppliers of photographic equipment and color chemistry had, for years, cautioned photographers about the necessity of stabilizing the lamp voltage in order to avoid waste of both time and expensive materials. It can easily be shown that a variation in the line voltage of only five volts results in a change in lamp intensity by about 15% (not to mention the substantial variation in the color temperature or spectral content of the lamp it produces). Such a variation can spell the difference between high quality and mediocre results.

Variations in line voltage are generally of two types: (1) those which are short-lived, momentary surges or drops in line voltage; and (2) those which occur over relatively long periods of time, (e.g. hours or days). The former type of variations are sometimes referred to as electrical transients. They are produced, for example, during the start-up high current-drawing appliances, such as refrigerators, dryers and furnaces. The latter type of variations results from gradual changes in the total load on a power company's generator or from cutbacks in power initiated by the power company.

Heretofore, photographers had a choice between two types of general purpose voltage regulators for maintaining a substantially constant lamp voltage. The type most frequently used, and the one which has become the industry standard, is the saturable-core, constant voltage transformer. Properly used, it regulates voltage quite well. Its primary disadvantages, however, are its size, weight, and cost, each of such factors increasing in direct proportion to the power rating of the transformer. This type of regulator is gradually seeing less use because the lamp power in color enlargers has increased to 500 watts and beyond.

Another disadvantage of the saturable core regulator, one not generally recognized, is that the degree of regulation is dependent upon the load being drawn. To achieve the specified regulation, it is necessary to match the load to the regulator. This precludes purchasing a regulator which is sized to meet the largest anticipated need and using it for smaller loads with the specified regulation.

A further disadvantage of the saturable core regulator is the sixty cycle hum associated therewith. Many photographers find this hum virtually unbearable in a small, confining darkroom. Further, care must be taken to keep the vibration associated with the hum away from the enlarger.

The second available choice in voltage regulating equipment is the direct current type. While well designed regulators of this type provide adequate regulation, the D.C. output is a serious disadvantage. Direct current regulators cannot be used with a transformer to change the voltage applied to the lamp. This is a serious disadvantage for those who wish to use low voltage quartzhalogen lamps, or to those who want to increase the lamp voltage to enhance the lamp intensity for extra large prints. Another problem is that sooner or later someone will accidentally plug equipment other than lamps (e.g. timers, blowers, etc.) into the D.C. regulator. Many photographers have learned to their dismay that A.C. equipment in their darkrooms is seriously damaged or ruined by D.C. voltage.

SUMMARY OF THE INVENTION

In accordance with the present invention, there is provided a voltage regulating apparatus which is ideally suited for darkroom use for regulating the line voltage applied to the printer or enlarger lamp. In its broadest sense, the regulating apparatus of the invention comprises a first circuit for generating a D.C. signal having an amplitude proportional to the instantaneous r.m.s. line voltage, and a second circuit for momentarily interrupting the line voltage, preferably at the start of each half cycle, the duration of such interruption being directly related to the instantaneous amplitude of the D.C. signal generated by the first circuit. According to a preferred embodiment, a non-linear function generating circuit modifies the D.C. signal provided by the first circuit to compensate for the non-linearity of the relationship between the r.m.s. value of the output voltage and the peak-to-peak amplitude of the line voltage. A timing circuit, operatively coupled to the output of the non-linear function generator, serves to vary the non-conduction angle of a conventional triac to maintain the r.m.s. voltage applied to the load substantially constant.

The objects and advantages of this invention will become more apparent to those skilled in the art from the ensuing description, reference being made to the accompanying drawings.

DETAILED DESCRIPTION OF A PREFERRED EMBODIMENT

Figure 1:
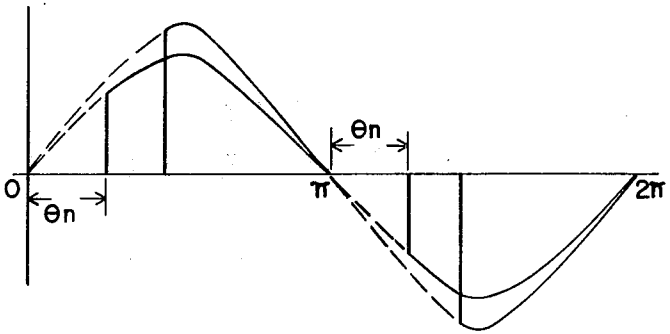
FIG. 1 illustrates various waveforms produced at the output of the regulator of the invention.

The voltage regulator of the invention is an A.C. voltage regulator which accepts a varying sinusoidal input from a conventional A.C. power line and produces an A.C. output voltage having a substantially constant r.m.s. value. In general, regulation is achieved by the use of a phase-controlled switching circuit connected in series with the load requiring regulated voltage. To produce a substantially constant r.m.s. value from a sinusoidal input signal of varying peak-to-peak amplitude, the regulating circuit of the invention acts to interrupt or turn off the sinusoidal input for a predetermined time interval (e.g. a few thousandths of a second), preferably at the beginning of each half cycle. The duration of the interruption in the sinusoidal input signal is a function of the instantaneous amplitude of the input signal. By varying the angle $\theta_n$ at which each signal commences, the r.m.s. voltage can be altered in accordance with the following equation:

$$\frac{E_o}{E_m} = \sqrt{\frac{\pi - \theta_n + \mathrm{Sin}2\theta_n/2}{2\pi}} \qquad (1)$$

where $E_o$ = the r.m.s. output voltage $E_m$ = amplitude of the A.C. sine wave input $\theta_n$ = the angle at which the signal begins The basis for phase-controlled regulation can be readily appreciated from the above equation. As the amplitude of the A.C. line voltage $E_m$ increases or decreases, the value of the angle $\theta_n$ can be adjusted to hold the r.m.s. output voltage $E_o$ constant. Phase controlled signals of different amplitude but of the same r.m.s. value are shown in FIG. 1.

The general approach for the regulator of the invention is to continuously monitor the line voltage and to generate, for each value of line voltage, a signal to vary the angle $\theta_n$ in order to hold the r.m.s. value of the output voltage constant. It should be noted in the above equation that, with $E_o$ held constant, the relationship between $E_m$ and $\theta_n$ is a non-linear relationship, and that the generation of a non-linear function is required for perfect regulation.

Figure 2:
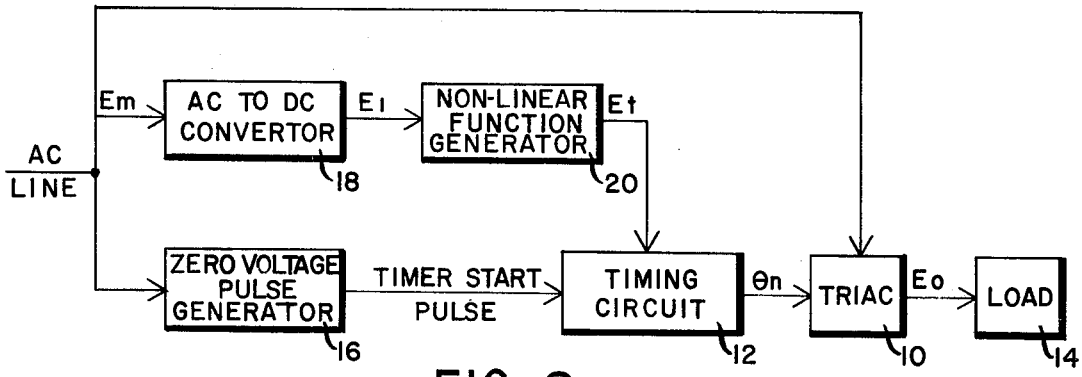
FIG. 2 is a block diagram of a preferred voltage regulating circuit of the invention.

The regulator of the invention is depicted in block diagram form in FIG. 2. In addition to the elements shown, the regulator includes a power supply section which generates +30V D.C. and 10V D.C. to supply power and bias voltages for the integrated circuitry of the regulator. As shown, the A.C. line input is fed to a conventional triac 10, a solid state switch which is capable of very rapidly switching A.C. signals. As will be seen from the ensuing description, the non-conduction angle of time interval during which time the triac is non-conductive for the purpose of maintaining the r.m.s. value of its output substantially constant is controlled by a timing circuit 12. The output of the timing circuit is in the form of a pulse which serves to trigger the triac at a point in time of each half cycle to maintain the r.m.s. value of each half cycle substantially constant. The triac remains conducting for the remainder of the half cycle. When the current passing through the triac drops to nearly zero (e.g. when the line voltage passes through zero) the triac becomes nonconducting and remains so until triggered again by the timing circuit.

To initiate the timing cycle, a conventional zero voltage pulse generator 16 is employed. As shown, the A.C. line voltage is fed to the zero voltage pulse generator. This circuit detects when the A.C. line is near the zero crossing point, and generates a pulse which begins just prior to the zero crossing the A.C. line. The width of such pulse is about 100 microseconds, and the pulse begins about 50 microseconds before the line crosses zero. When the timing circuit receives an input pulse from pulse generator 16, the timing cycle is initiated. The duration of this timing cycle is controlled by a D.C. signal applied to the timing circuit. In order to complete the regulation function, it is necessary to measure the A.C. line voltage and to vary the D.C. voltage applied to the timer in a manner which will produce the proper $\theta_n$ for each value of line voltage. This is accomplished by means of the A.C. to D.C. converter 18 and the non-linear function generator 20.

The A.C. line is fed to the A.C. to D.C. converter which produces a D.C. output proportional to the amplitude of the A.C. line. The D.C. output of the converter is thus a measure of the actual line voltage at any given time.

As mentioned above, the time interval required to produce a constant r.m.s. output is a non-linear function of $E_m$. In addition, a second non-linear function exists in the electronic timer itself. That is, the output $\theta_n$ of the timing circuit is a non-linear function of the input D.C. voltage. If the output of the A.C. to D.C. converter were directly applied to the timer, the resulting regulation would be very poor because of these nonlinearities. The purpose of the non-linear function generator is to produce a third non-linear function which produces perfect regulation. That is, for each value $E_m$, the function generator produces the output voltage necessary to produce the proper $\theta_n$ to exactly compensate for the $E_m$ change above a predefined value.

The use of the function generator mentioned above and the specific function generated are unique and important aspects of the regulator of the invention. Since the r.m.s. value of a phasecontrolled A.C. waveform such as that shown in FIG. 1 is inherently a nonlinear function of the angle $\theta_n$, only a non-linear function such as that produced by the function generator will produce perfect regulation. Conversely, any approach that does not at least compensate for the nonlinearities of the above equation 1 will produce imperfect regulation.

Figure 3:
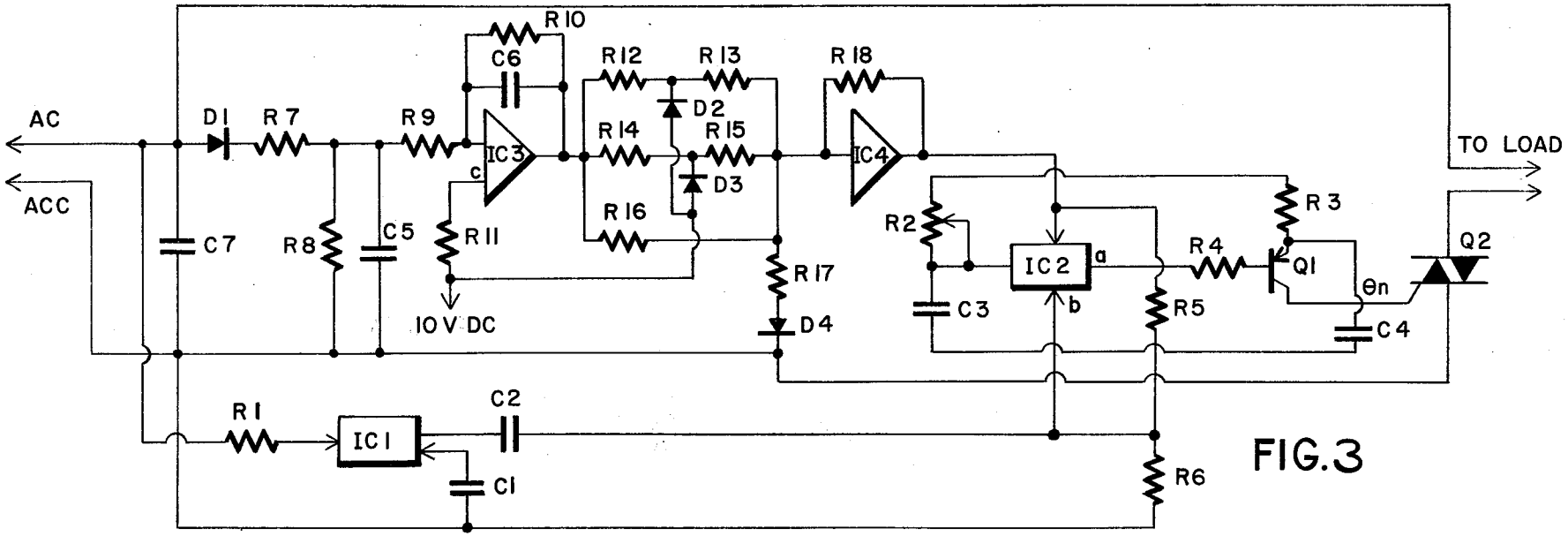
FIG. 3 is an electrical schematic of a voltage regulating circuit constructed in accordance with a preferred embodiment of the invention.

A preferred circuit for implementing the block diagram of FIG. 2 is schematically illustrated in FIG. 3. Generation of the zero voltage pulse is accomplished primarily by an integrated circuit IC1. This integrated circuit is a conventional zero voltage switch (e.g. a CA3079 switch made by Radio Corporation of America); it is designed primarily to trigger triacs at the zero crossing of the A.C. line. The A.C. line voltage is fed to IC1 through resistor R1 and a negative output pulse is generated at each zero crossing of the line. IC1 has a self-contained power supply to power its own internal circuitry, and capacitor C1 is an external capacitor used for power supply filtering.

The output of IC1 is capacity coupled through capacitor C2 to an integrated circuit IC2 which, together with transistor Q1, resistors R2–R4 and capacitors C3 and C4, provide the timing circuit function. Preferably, integrated circuit IC2 comprises a NE555V integrated timer made by Motorola Corporation. Resistors R5 aand R6 form a voltage divider network to prevent IC2 from triggering for all inputs from the non-linear function generator, except when a pulse is received from IC1. Prior to the zero crossing of the line, the output (a) of IC2 is zero and capacitor C3 is shorted by integrated circuit IC2. When a pulse appears at the input (b) of IC2, the output (a) of IC2 goes high (+10V) and the short is removed from the capacitor, which then begins charging. When the output of IC2 goes high, transistor Q1 is turned off, preventing the triggering of triac Q2. Resistor R4 serves to limit the base current drawn by transitor Q2. When transistor Q1 is turned off, capacitor C4 is charging though resistor R3. Shortly after the initiation of the timing cycle, the current through the triac drops below the holding current and it is turned off. When the voltage across capacitor C3 exceeds a predetermined threshold level, namely, the amplitude of the D.C. output of the non-linear function generator described below, the output of IC2 goes low and capacitor C3 is rapidly discharged by IC2. When the output of IC2 goes low, transistor Q1 is turned on, discharging capacitor C4 into the gate of triac Q2, thereby turning triac Q-2 on to provide current to the load. The time interval $\theta_n$ during which the triac conducts depends upon the threshold voltage at which IC2 goes low. This threshold is adjustable by varying the impedance of resistor R2. As the threshold value increases, $\theta_n$ increases, and vice versa. It should be noted that since the voltage across capacitor C3 varies exponentially, $\theta_n$ will be a non-linear function of the triggering threshold of IC2.

Circuitry will now be described for generating a D.C. signal having an amplitude proportional to the amount by which the r.m.s. line voltage exceeds the value at which regulation is to be maintained. As shown in FIG. 2, the A.C. line is also fed to an A.C. to D.C. converter. Referring to FIG. 3, this converter circuit comprises diode D1, resistors R7 and R8 and capacitor C5. These elements convert the high voltage A.C. of the line to a filtered D.C. signal having an amplitude proportional to the peak-to-peak amplitude of the A.C. line voltage. The values of resistors R7 and R8 are chosen to provide a relatively short time constant to assure fast response. Their values also assure that the transient response of the D.C. voltage across capacitor C5 will be approximately the same for both increases and decreases in line voltage. As the line voltage varies (e.g. from 105 volts to 129 volts), the D.C. voltage across C5 will vary from approximately 8.5 to 10.5 volts.

The A.C. to D.C. converter circuit also comprises a conventional operational amplifier IC3, which, via resistors R9–R11 and capacitor C6, serves to suppress, invert and amplify its input. The output of amplifier IC3 changes from approximately 25 volts to 5 volts as the line varies from 105 to 129 volts A.C. The noninverting input (c) of IC3 is biased at 10 volts D.C. through resistor R11 to suppress the input signal. The output of amplifier IC3 serves as the input to the non-linear function generator described below.

Figure 6:
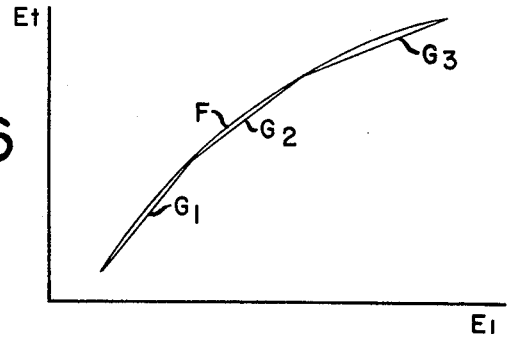
FIG. 6 is a graph illustrating the transfer function of a non-linear function generator.

The basic non-linear function generated by function generator 20 is graphically illustrated in FIG. 6 by the solid curve F, where $E_1$ and $E_t$ respectively represent the input and output of the function generator. The transfer function of the non-linear function generator compensates for the non-linearities of the triac and timing circuits. Also, it takes into account the linear relationship between the input and output of converter 18. The non-linear relationship between $\theta_n$ and $E_o$ is expressed in equation (1) above. The non-linearity of the timing circuit described above is defined by the equation:

$$E_t = K(1 - e^{-\theta_n/2Wt}) \quad (2)$$

where $E_t$ = the output of IC2;

$W$ = the line frequency; and $K$ = a constant (the supply voltage of IC4)

Figure 4:
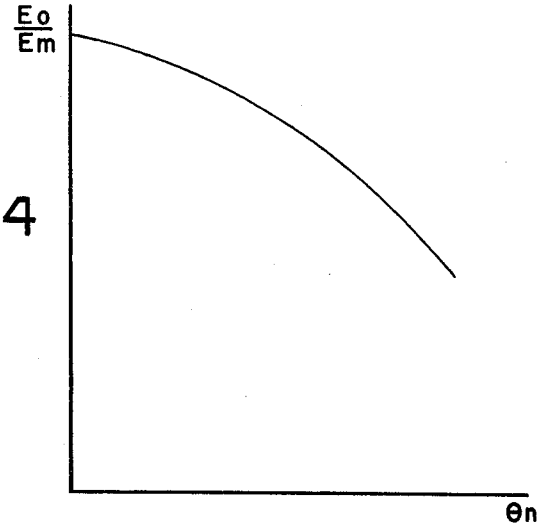
FIG. 4 is a graph illustrating the manner in which the nonconduction angle of a triac varies with the amplitude of an input voltage to achieve a constant r.m.s.
Figure 5:
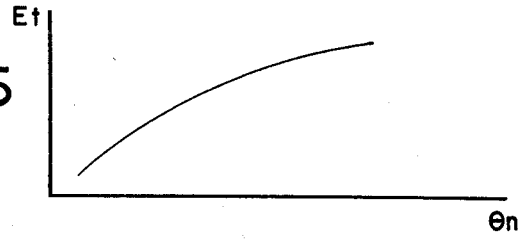
FIG. 5 is a graph illustrating how the non-conduction angle of a triac varies with the D.C. signal applied to a timing circuit.

The graphs of FIGS. 4 and 5 represent graphical solutions to equations (1) and (2) above.

The circuitry of the non-linear function generator actually comprises three linear networks which provide a piecemeal approximation of the FIG. 6 curve. Three sections were sufficient to achieve a regulating accuracy of better than 1%. Referring again to FIG. 3, generator 20 comprises resistors R12–R16, diodes D2 and D3, and operational amplifier IC4. When the line voltage is low (e.g. 105 volts), the output $E_1$ of converter 18 is high, and diodes D2 and D3 are back-biased off. Under these conditions, current flows into the summing point of IC4 through three paths, R12 + R13, R14 + R15, and R16. Thus, the gain of operational amplifier IC3 is high in this region, as represented by $G_1$ in FIG. 6. As the line voltage increases, $E_1$ decreases until diode D2 begins to conduct. This reduces the gain of IC3 to $G_2$. Similarly, as the line voltage increases further, diode D3 begins to conduct and the amplifier gain is further decreased to $G_3$.

While the invention has been described in detail with particular reference to a preferred embodiment, it will be understood that variations and modifications can be made without departing from the spirit and scope of the invention. For instance, the timing circuit can be made to have a linear relationship between the applied signal, $E_t$ and the angle $\theta_n$. In this case, the non-linear function generator can be used to compensate only for the non-linear relationship between the angle $\theta_n$ and the amplitude of the A.C. source, as given by equation (1).

I claim:

1. An r.m.s. voltage regulating apparatus for maintaining the r.m.s. voltage $E_o$ supplied to a load from an A.C. voltage source of varying amplitude $E_m$ at a substantially constant value, said apparatus comprising:

a. a rectifying circuit coupled to the A.C. voltage source for continuously generating a D.C. signal having an instantaneous amplitude proportional to the instantaneous peak-to-peak amplitude of said source;

b. interrupting circuit means coupled to the voltage source and said rectifying circuit for interrupting the output of the source at the start of each half cycle, the phase angle $\theta_n$ of such interruption being proportional to the instantaneous amplitude of said D.C. signal, said interrupting circuit means comprising a pulse generator for generating a first pulse at the start of each half cycle of the A.C. output of the voltage source, a timing circuit which is coupled to said rectifying circuit and said pulse generator for generating a second pulse, a predetermined time after said timing circuit receives a pulse from said pulse generator, the duration of said predetermined time being dependent exclusively upon the instantaneous amplitude of said D.C. signal and controlling the phase angle $\theta_n$ of interruption, and a normally non-conducting switching circuit, operatively coupled to said timing circuit output, said switching circuit being adapted to switch to a conducting state in response to the generation of said second pulse by said timing circuit, and to remain in a conducting state until the A.C. current through the load is substantially zero; and c. A non-linear function generating circuit interconnecting said rectifying circuit and said interrupting circuit means for substantially compensating for the non-linearity in the relationship between the amplitude $E_m$ of the A.C. source and said phase angle $\theta_n$, as expressed by the equation:

$$\frac{E_a}{E_m} = \sqrt{\frac{\pi - \theta_n + \mathrm{Sin}2\theta_n/2}{2\pi}}.$$

and for substantially compensating for a non-linearity between the timing circuit input voltage $E_t$ and the phase angle $\theta_n$ of interruption, as expressed by the equation:

$$E_t = K(1 - e^{-\theta_n/2W_t})$$

where W is the frequency of the A.C. source and K is a constant.

2. The voltage regulating apparatus of claim 1 wherein said switching circuit comprises a triac.

* * * * *